United States Patent [19]

Lassota

[11] 3,974,803

[45] Aug. 17, 1976

[54] INTERNAL COMBUSTION ENGINE WITH GYRATORY PISTON AND CYLINDER MOVEMENT

[76] Inventor: Marek J. Lassota, 4132 W. Roscoe St., Chicago, Ill. 60641

[22] Filed: Sept. 16, 1974

[21] Appl. No.: 506,613

Related U.S. Application Data

[63] Continuation-in-part of Ser. No. 221,198, Jan. 27, 1972, abandoned, and a continuation-in-part of Ser. No. 361,472, May 18, 1973, abandoned, and a continuation-in-part of Ser. No. 425,507, Dec. 17, 1973, abandoned.

[52] U.S. Cl. ..... 123/42; 123/45 R; 123/50 R; 123/43 R; 123/18 R; 91/196; 91/210; 92/54; 92/118

[51] Int. Cl.[2] ..... F02B 59/00

[58] Field of Search ..... 123/42 R, 45 R, 50 R, 123/50 A, 50 B, 18 R, 18 A, 43 R, 190 BD, 190 B, 190 BP; 91/196, 197, 176, 210; 92/54, 118, 119, 117 A, 117 R; 417/464; 418/52, 53, 68

[56] References Cited

UNITED STATES PATENTS

| | | | |
|---|---|---|---|
| 1,351,783 | 9/1920 | Moeglin | 123/51 AA |
| 1,771,780 | 7/1930 | Garabello | 123/190 BD |
| 3,090,366 | 5/1963 | Nagelmann | 123/42 |
| 3,315,653 | 4/1967 | Chicurel | 123/51 B |
| 3,630,178 | 12/1971 | Erickson | 123/50 R |
| 3,692,005 | 9/1972 | Boske | 123/51 R |
| 3,835,823 | 9/1974 | Miller | 123/42 |

FOREIGN PATENTS OR APPLICATIONS

| | | | |
|---|---|---|---|
| 740,703 | 10/1943 | Germany | 123/42 |
| 131,884 | 3/1920 | United Kingdom | 123/190 BD |
| 8,766 | 1912 | United Kingdom | 123/50 A |

*Primary Examiner*—Wendell E. Burns
*Attorney, Agent, or Firm*—Dominik, Knechtel, Godula & Demeur

[57] ABSTRACT

An internal combustion engine wherein a piston element with rectilinear sides operates within a movable cylinder-piston element having rectilinear sidewalls, and wherein the combustion chamber has a polyhedral shape. Rotatable crankshafts are mounted in each of the piston and cylinder-piston elements so that said elements follow gyratory paths in opposite directions to effect a variable volume combustion chamber. A cylindrical valve member is rotated in timed sequence to the rotation of the crankshafts so that intake and exhaust ports are sequentially opened and closed during the combustion cycles. One or both of the crankshafts may operate or be joined to a drive shaft or shafts for work output, said crankshafts being interconnected by gear means to coordinate gyratory movement of the piston and cylinder-piston elements.

13 Claims, 26 Drawing Figures

INTERNAL COMBUSTION ENGINE WITH GYRATORY PISTON AND CYLINDER MOVEMENT

FIELD OF THE INVENTION

This invention relates to an internal combustion rotary engine in which rotatable piston and cylinder-piston elements and stationary cylinder walls, collectively forming a combustion chamber, have coacting flat rectilinear faces. The piston and cylinder-piston elements follow opposite gyratory paths during operation of the engine to effect a variable volume combustion chamber which follows an oscillating up and down path, whereby balancing of the engine, minimal vibration operation, necessary sealing of the combustion chamber, proper cooling, and improved efficiency of operation are attained. This application is a continuation-in-part of Ser. No. 221,198 filed Jan. 27, 1972 and a continuation-in-part of Ser. No. 361,472, filed May 18, 1973, and a continuation-in-part of Ser. No. 425,507 filed Dec. 17, 1973, by the same applicant all now abandoned.

REFERENCE TO THE PRIOR ART

Numerous efforts have been made to depart from the conventional engines having a reciprocating piston and a stationary cylinder so that disadvantages of such engines may be overcome, and new advantages may be realized. One popular approach has been generally to develop various types of rotary internal combustion engines or so called swirl-piston or rotary piston devices represented by the well known Wankel engine. Representative rotary engines may be seen in prior art patents such as U.S. Pat. No. 1,249,881; U.S. Pat. No. 2,590,132; and U.S. Pat. No. 2,179,401. A further representative teaching of the Wankel type may be found in U.S. Pat. No. 3,584,984. The prior art represented by such teachings involves a great number of rotary engines having arcuate or curvilinear surfaces between co-working elements. This presents serious problems in efficient sealing, and adequate sealing is necessary to assure efficient operation.

OBJECTS AND ADVANTAGES OF THE INVENTION

It is one important object of the present invention to provide an improved prime mover or compressor wherein a variable volume chamber follows a generally up and down movement as a result of piston and cylinder-piston elements following opposite gyratory movements, such gyratory movements attained by a polyhedral piston element with opposite pairs of parallel sides operating between opposite rectilinear walls of a cylinder-piston element.

Another important object of the present invention is to provide an improved internal combustion rotary engine wherein a combustion chamber follows a generally up and down movement as a result of piston and cylinder-piston elements following opposite gyratory movements, such gyratory movements attained by a polyhedral piston element with opposite pairs of parallel sides operating between opposite rectilinear walls of a cylinder-piston element to thereby attain improved sealing in operation and improved operating efficiency.

Yet another important object of the invention is an improved rotary internal combustion engine wherein gyratory movements of the piston and cylinder-piston elements are between stationary, rectilinear, flat walls, which partly form the combustion chamber, thus allowing improved sealing between the stationary walls and the gyratory piston and cylinder-piston elements thereby providing increased efficiency of operation.

Still yet another important object of the present invention is to realize the advantages of a polyhedral piston element operating between quadrilateral sidewalls of a cylinder-piston element by moving said elements in opposite gyratory paths with the aid of crankshafts which are coordinated relative to their movements.

Yet still another important object is an improved internal combustion rotary engine wherein gyratory movements of piston and cylinder-piston elements in an engine housing or casing compress air so that means may be provided to deliver said compressed air for charging or supercharging operation of the combustion chamber.

Still yet another important object of the present invention is to provide improved geometry of the combustion chamber to provide flexibility in the design of various compressions ratios.

yet another important object of the present invention is to provide an internal combustion engine of the type described which operates to further advantage in association with an improved cylindrical valve member which is timed to rotate in relationship to the gyratory movement of the cylinder-piston and piston elements to provide desired opening and closing of intake and exhaust ports.

Still yet another important object of the present invention is to provide an improved rotary internal combustion engine of the type described which has relatively few parts, and is relatively lightweight, and provides high volumetric efficiency and more horsepower per pound of weight. In attaining this object, there is provided an engine which has advantages of simplicity in design, economy in manufacture, ruggedness of construction, ease of use, and efficiency of operation.

SUMMARY OF THE INVENTION

To attain particular advantages of good sealing and engine operation, there is provided a polyhedral type of piston element which has opposite pairs of parallel sides. The piston element reciprocates between parallel rectilinear, flat sidewalls of a cylinder-piston element so adjoining rectilinear, flat sides of a polyhedral type piston element, together with seal elements, located in walls of the piston element can lead to desired sealing efficiency in long lasting operation. The cylinder-piston element also has a polyhedral type of body portion with opposite pairs of parallel sides. The cylinder-piston element likewise operates in the manner of a piston. A rotatable crankshaft is mounted in each of the piston and cylinder-piston elements so that each of said elements is inducted to follow a gyratory path in opposite directions. In this way, the cylinder-piston element dynamically participates in the power transmission rather than operating as a static member for the piston. The crankshafts have ends which extend out of the engine casing, and such ends are interconnected by gearing means so that rotation of each shaft, and gyratory movement of the elements are coordinated.

One or both of the crankshafts can then operate as a drive shaft, or can be connected to a shaft or shafts which operate as a power or drive shaft. A plurality of such piston and cylinder elements can be aligned to drive a common power or drive shaft.

Necessary seals may be provided between the coacting rectilinear, flat faces of the piston and cylinder-piston elements, as well as between the piston and cylinder-piston elements, and the coacting rectilinear engine stationary walls positioned at opposite sides to provide a closed polyhedral combustion chamber of varying dimensions. The oscillating path of the combustion chamber is therefore defined by piston and cylinder-piston elements which move in a gyratory path, and by rectilinear, flat walls which are stationary. In addition to advantages of efficiency in sealing the combustion chamber of described type, such an assembly is manufactured economically since the shapes involved are very simple and since there is no need for the use of special materials.

Fuel-air mixtures and exhaust gases are moved to and from the combustion chamber by an improved cylindrical valve member which is rotated in timed sequence to the crankshafts, such a valve member being interconnected to a crankshaft by a gear train. The illustrated cylindrical valve member is timed to rotate one full 360° turn for every two 360° turns of the crankshafts. In this way, both exhaust and intake ports are registered with an aperture communicating with the combustion chamber so that as intake, compression, power and exhaust occur, cylinder-piston and piston elements execute two gyratory movements.

DESCRIPTION OF THE VIEWS OF THE DRAWINGS

Use of the same numerals in the various views of the drawings, will indicate a reference to like structures, parts or elements, as any case may be.

DETAILED DESCRIPTION OF THE INVENTION

Figure 1:
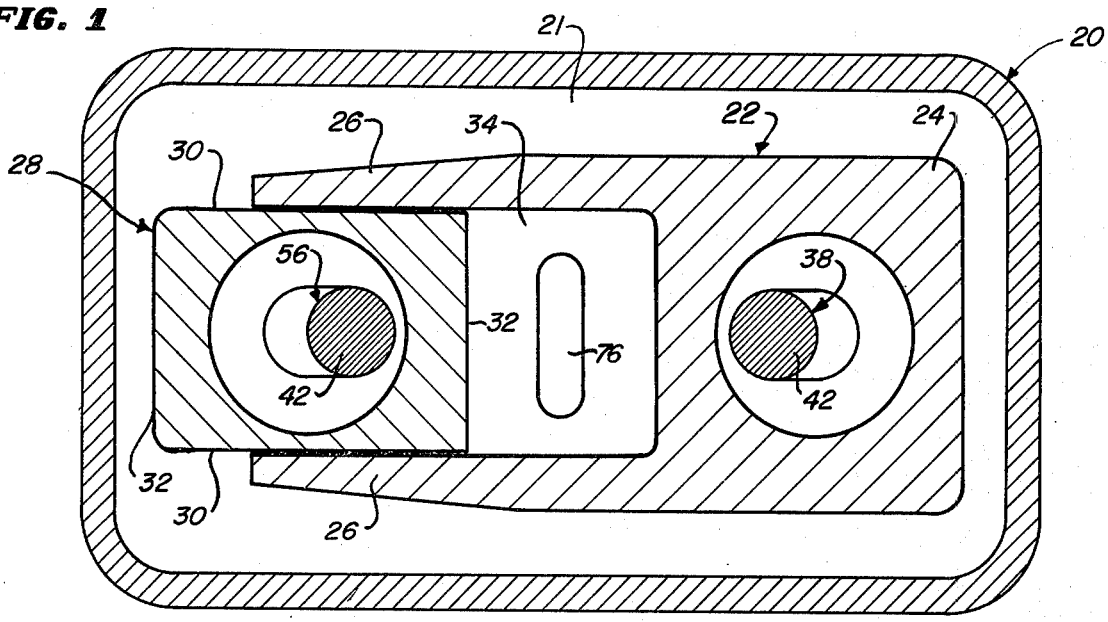
FIG. 1 is a somewhat schematic side sectional view of the internal combustion rotary engine, with parts removed for purposes of clarity.
Figure 2:
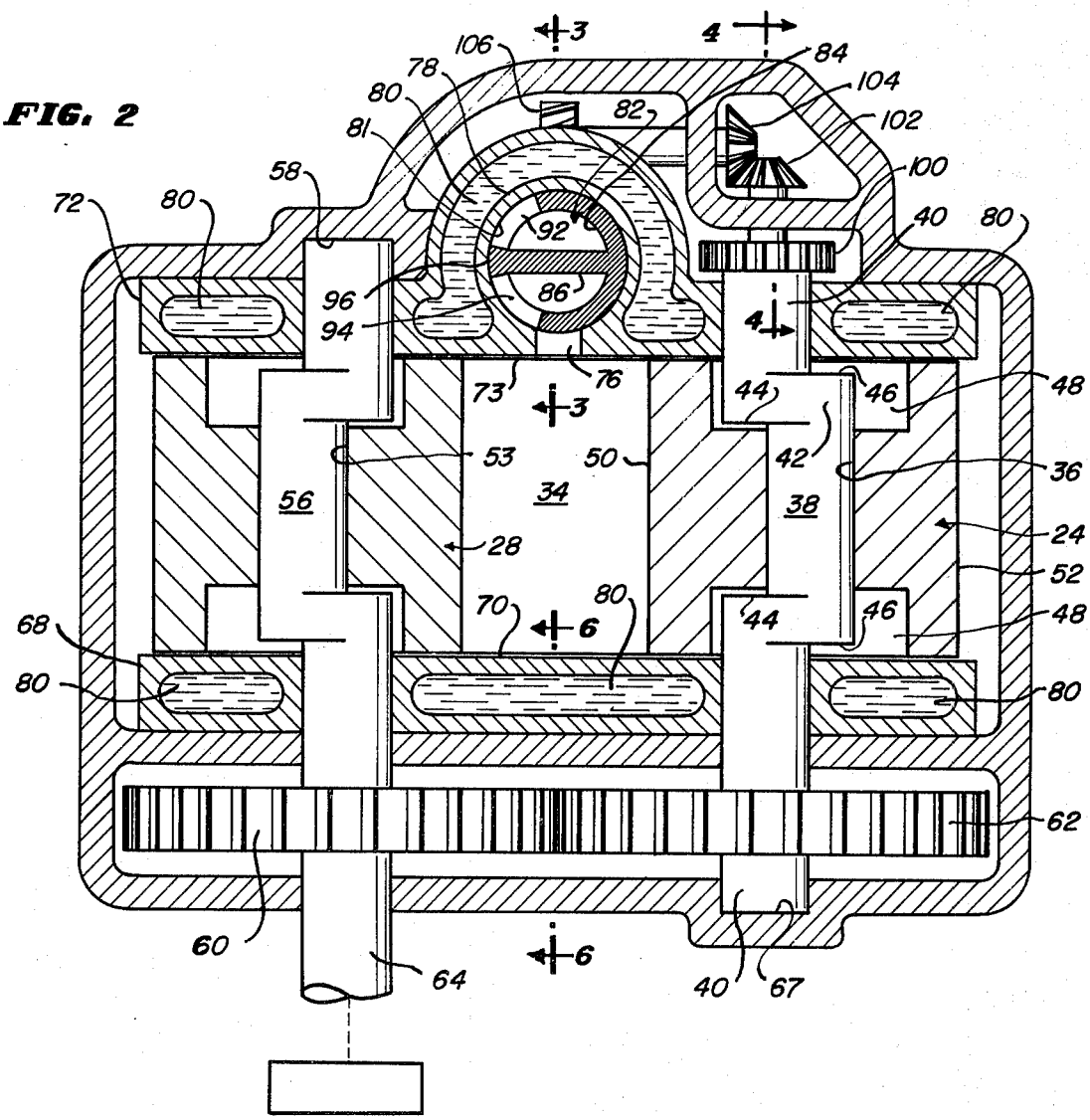
FIG. 2 is somewhat schematic view partially in section, taken along a plane normal to the view of FIG. 1.
Figure 3:
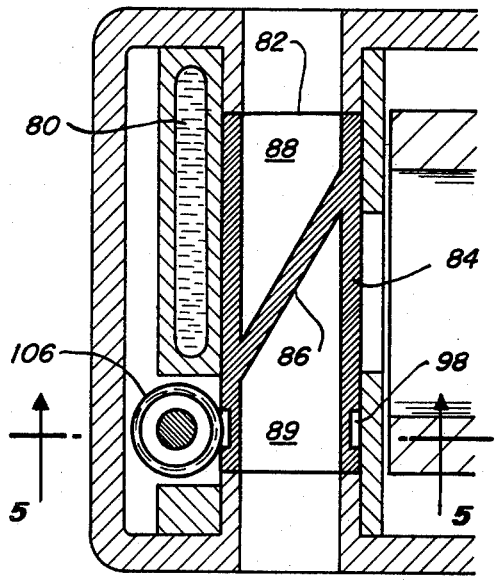
FIG. 3 is a somewhat schematic view in section, with parts removed, taken along line 3-3 in the view of FIG. 2, said view of FIG. 3 being rotated 90° for convenience.

Referring now to the drawings, FIGS. 1 and 2 show an engine housing 20 enclosing an engine housing chamber 21. Within the chamber 21 is located a rectilinear cylinder-piston element shown generally as 22. The cylinder-piston element includes a polyhedral type body 24 with spaced, parallel rectilinear, flat walls 26.

The terms "cylinder-piston" or "piston-cylinder" refer to a generally U-shaped element or body which operates in the way of both a cylinder and a piston, although the configuration of the element is not at all cylindrical.

A polyhedral type piston element 28 is operatively positioned between the rectilinear walls 26 of the cylinder-piston element. The piston element 28 has a pair of opposite parallel sides 30 which adjoin the rectilinear, flat sidewalls 26 of the cylinder-piston element. Another pair of opposite parallel sides 32 in the polyhedral piston are shown, one of such sides 32 changing the dimensions of the movable polyhedral combustion chamber 34.

The cylinder-piston element has a passageway 36 in which is rotatably mounted a cylinder-piston crankshaft 38. Such a crankshaft has aligned opposite end portions 40, and an offset intermediate portion 42. An inner pair of shoulders 44 and an outer pair of shoulders 46 demarcate the offset portion from the aligned end portions. Transverse portions of the crankshaft extending between extremities of the inner and outer shoulders rotate in cylindrical chambers 48 located in opposite sides of the cylinder-piston body 24. Such chambers 48 in the opposite sides do not alter the essentially polyhedral configuration of the cylinder-piston body, including flange portion 50, the face whereof partly defines the combustion chamber 34. A thinner outer flange portion 52 defines a terminating portion of the cylinder-piston body 24, and is remote from the combustion chamber 34.

Piston element 28 likewise has a passageway 53 similar to 36 in cylinder-piston element 22, and a piston crankshaft 56 which is similar to the crankshaft 38. Features in crankshaft 56 similar to those in crankshaft 38 shall not be described in detail, and description relating to crankshaft 38 should be carried over when considering crankshaft 56. Also, piston element 28 has cylindrical chambers in opposite sides of similar construction and for similar purposes as described in association with the cylinder-piston element 22.

Crankshaft 56 has one of its aligned end portions journaled at 58, the offset and end portions including bearing surfaces in their associated passageways. Crankshaft 56 has a circular gear 60 keyed or otherwise fixed thereto. Crankshaft 38 also has an aligned circular gear 62 keyed or otherwise fixed to end portion 40, as shown. A power or drive shaft 64 is connected to end 40 of crankshaft 56 or may be an integral extension thereof. The power or drive shaft 64 is joined to work output means, not shown. Crankshaft 38 has one of its end portions 40 journaled at 67, crankshaft 38 rotating clockwise in the view of FIG. 1. Crankshaft 56 rotates counterclockwise as shown in the view of FIG. 1, and such oppositely rotating crankshafts move the piston-cylinder and piston elements in opposite gyratory paths. Such crankshafts are connected through gears 60, 62 to coordinate or synchronize their rotation and the gyratory movements of the piston and cylinder-piston elements. Such gear interconnection also provides power transmissions to drive shaft 64.

The combustion chamber is further defined by stationary rectilinear, flat part 68 having a continuous combustion chamber sidewall 70. Another rectilinear stationary engine part 72 with chamber sidewall 73 is at the opposite side to complete definition of the polyhedral combustion chamber 34. Sidewall 73 has a substantially elongated communicating aperture 76. Stationary part 72 further includes a curvilinear wall portion 78, said stationary engine parts 68, 72 further having a plurality of communicating coolant chambers and circulating cooling fluid commonly shown as 80. It will be understood that coolant chambers and circulating fluid 80 will be located in other engine parts, as shown in other views.

Curvilinear chamber wall portion 78 substantially encloses a passageway 81 in which is located rotatable cylindrical valve member 82. Looking particularly at FIGS. 7–10, such a cylindrical valve member is shown to include a substantially continuous annular wall 84, and further includes a diagonal separator or web member 86 inside the valve member. An exhaust side or space 88 is to one side of the separator, and an intake side or space 89 is on the other side of the separator. An exhaust or outlet port 92 communicates with the exhaust side, and an inlet or intake port 94 communicates with the intake side. A midwall portion 96 separates the two ports, and the balance of the annular wall portion extends from the port to the other port. Diagonal separator 86 extends to the midwall portion as shown.

Figure 4:
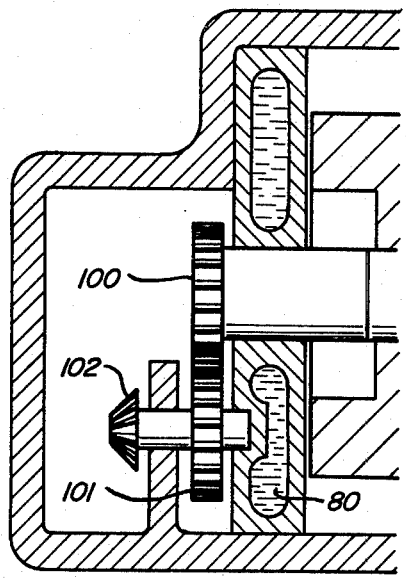
FIG. 4 is a somewhat schematic sectional view taken along line 4—4 in FIG. 2, said view of FIG. 4 being rotated 90° for convenience.
Figure 5:
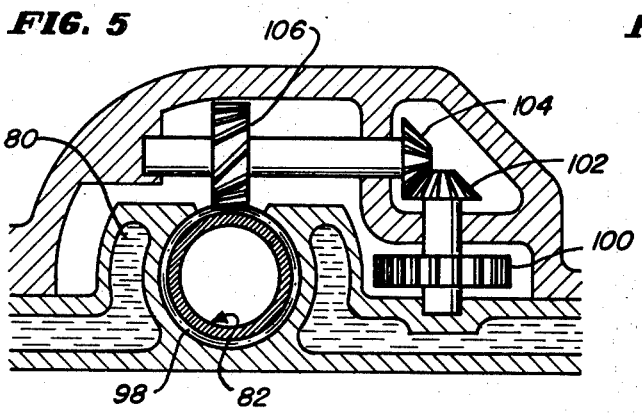
FIG. 5 is a somewhat schematic view taken along line 5—5 of FIG. 3, but rotated 90° for convenience.
Figure 6:
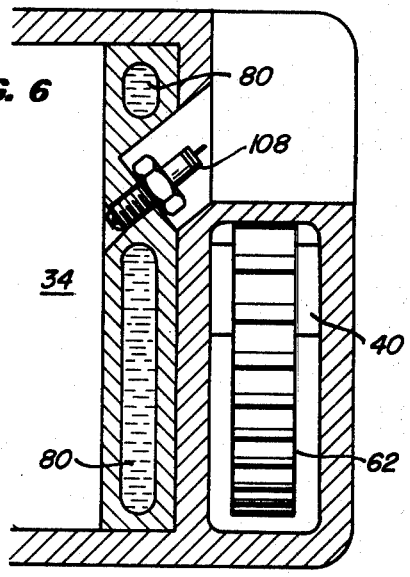
FIG. 6 is a somewhat schematic view, with parts removed, taken along line 6—6 in the view of FIG. 2, but rotated 90° for convenience.
Figure 7:
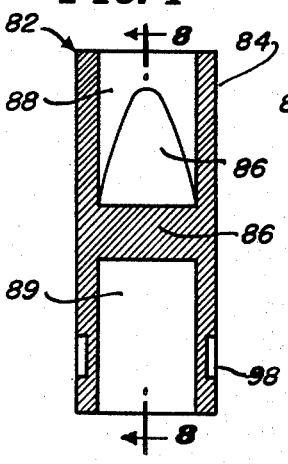
FIG. 7 is a side elevational view taken along a section plane parallel to the longitudinal axis of the cylindrical valve member.
Figure 8:
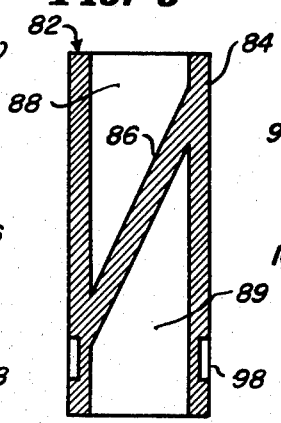
FIG. 8 is a sectional view taken along line 8—8 in the view of FIG. 7.
Figure 9:
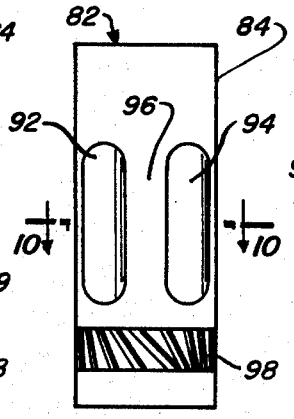
FIG. 9 is a side elevational view of the cylindrical valve member positioned like the valve shown in the view of FIG. 8.
Figure 10:
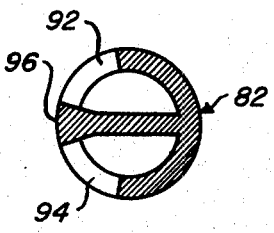
FIG. 10 is a sectional view taken along line 10—10 in FIG. 9, but rotated 90° for convenience.

The illustrated valving means is timed to rotate one complete 360° turn for every two 360° turns of the crankshafts. A gear train is shown connecting the cylindrical valve member and one of the crankshafts 38. The cylindrical valve member is shown with a helical gear 98 formed in the annular wall 84. Actuation of this gear through the gear train rotates the cylindrical valve member at desired rotational relationship to the crankshafts, as well as the piston and cylinder-piston elements. The gear train includes a gear 100 keyed or otherwise fixed to an end 40 of the cylinder-piston crankshaft 38. Gear 100 meshes with gear 101, the horizontal axis of gears 100 and 101 lying in a common plane (FIGS. 4 and 5). Gear 101 is keyed or otherwise fixed to the shaft bevel gear 102 which, in turn meshes with bevel gear 104 at right angles in a conventional way. A helical gear 106 is keyed or otherwise fixed to the shaft of bevel gear 104, and such helical gear meshes with annular valve helical gear 98 to complete the gear train. The shafts of the bevel gears are rotatably mounted in a passageway of the engine housing, and are journaled at other parts of the engine housing, as best indicated in the view of FIG. 5. It will be understood that the intake fuel-air mixture may be delivered in usual ways by carburetor or injection and that the mixture will be ignited by a spark, a sparkplug 108 being shown mounted in an engine housing part in the view of FIG. 6. In the compression-ignition (Diesel cycle) version of this engine, a fuel injector will replace the sparkplug in generally the same location.

THE OPERATION OF THE INVENTION

Figure 11:
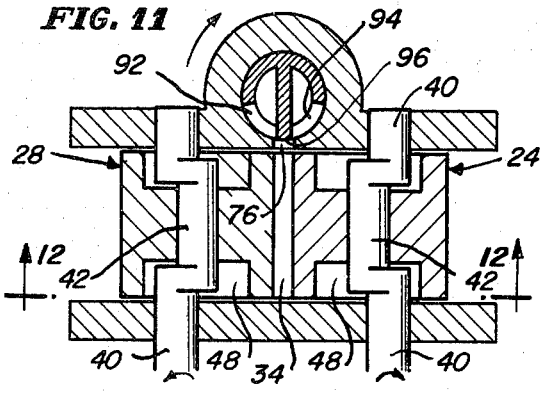
FIG. 11 is a schematic view, mostly in section, showing the engine at the end of the exhaust stroke and start of the intake stroke.
Figure 12:
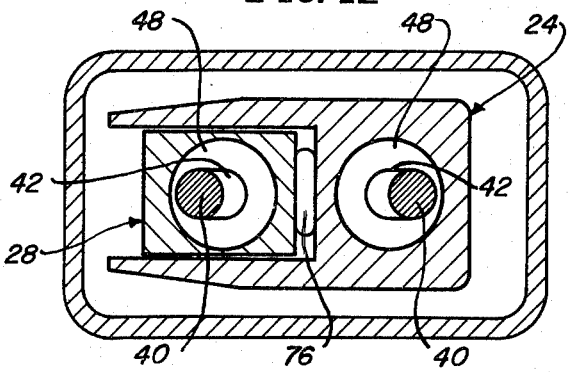
FIG. 12 is a sectional view taken along line 12—12 in FIG. 11, but with parts removed.

Reference to FIGS. 11–26 will indicate a representative illustration of the operation of the invention. The view of FIG. 11 shows the midwall portion 96 of the cylindrical valve member partially closing the communicating aperture or gap 76 leading to the combustion chamber. This can be taken as representing the end of the exhaust stroke and the start of the intake stroke, the crankshafts being so positioned that the offset portions 42 are laterally displaced from end portions 40.

Figure 13:
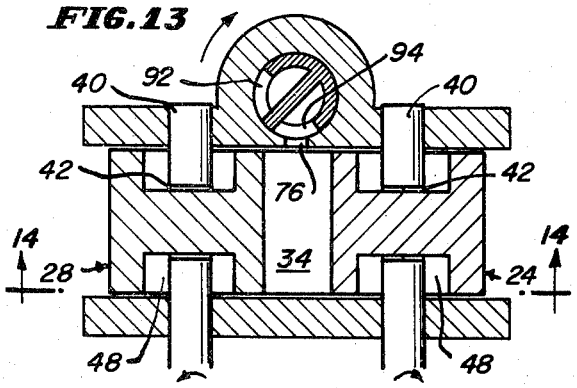
FIG. 13 is a sectional view of the engine showing execution of the intake stroke.

The cylindrical valve member continues its rotation in a clockwise manner in these views so that intake port 94 registers with the gap 76 to allow intake of the fuel-air mixture into combustion chamber 34. This is shown in the view of FIGS. 13 and 14, and is representative of execution of the intake stroke.

Figure 15:
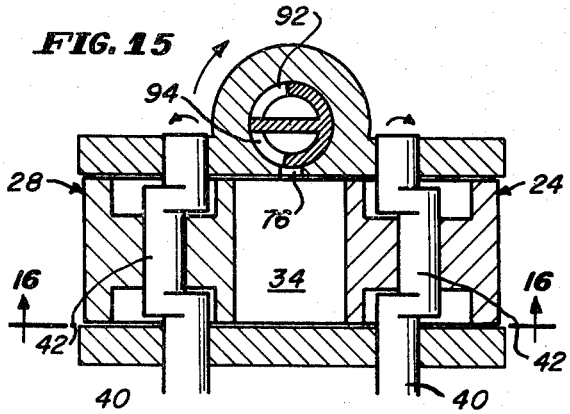
FIG. 15 is a sectional view of the engine showing the end of the intake stroke and the beginning of the compression stroke.
Figure 16:
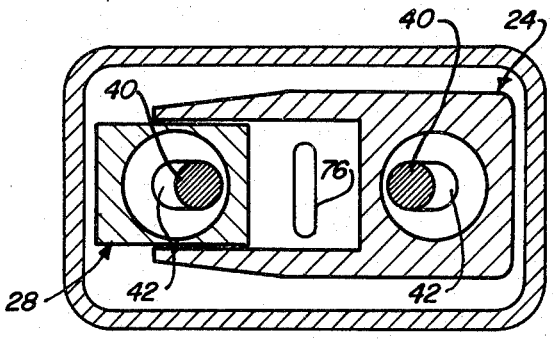
FIG. 16 is a sectional view taken along line 16—16 in FIG. 15, but with parts removed.
Figure 17:
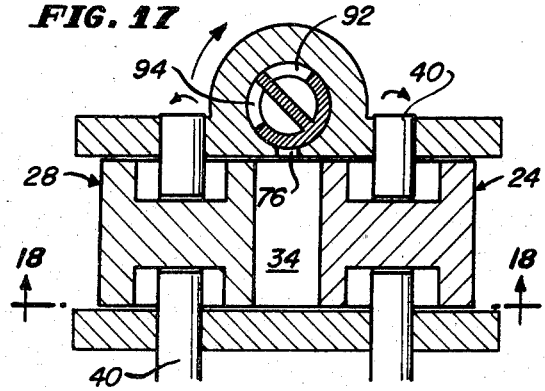
FIG. 17 is a sectional view of the engine showing execution of the compression stroke.

Continued rotation of the cylindrical valve member results in closing the gap 76 by portions of the annular wall 84. This is shown in the views of FIGS. 15 and 16, such views indicating the end of the intake stroke and the beginning of the compression stroke. The gap 76 remains closed during execution of the compression stroke as indicated in the views of FIGS. 17 and 18.

Figure 19:
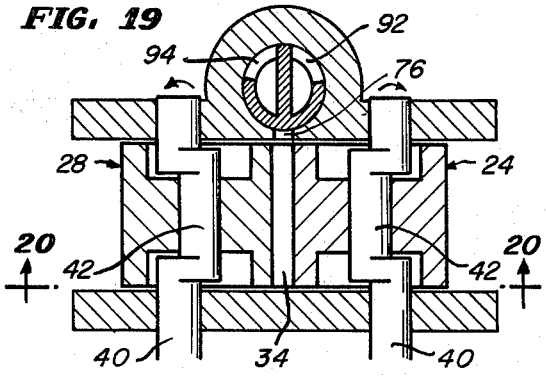
FIG. 19 is a sectional view of the engine showing the end of compression stroke, ignition and beginning of the power stroke.
Figure 20:
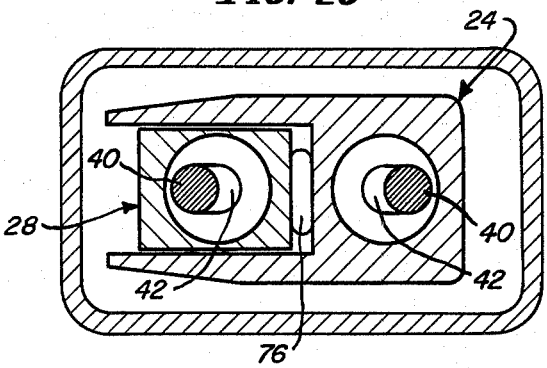
FIG. 20 is a sectional view taken along line 20—20 in FIG. 19, but with parts removed.
Figure 21:
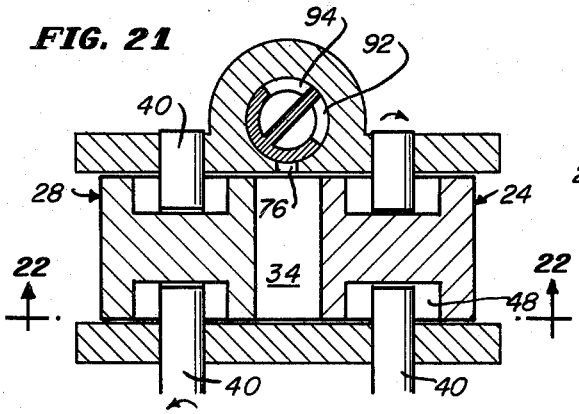
FIG. 21 is a sectional view of the engine showing the power stroke.
Figure 22:
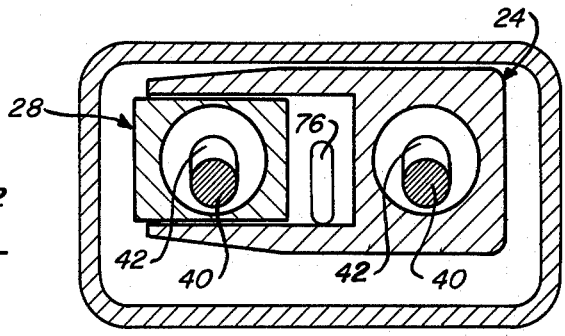
FIG. 22 is a sectional view taken along lien 22—22 in the view of FIG. 21, but with parts removed.
Figure 23:
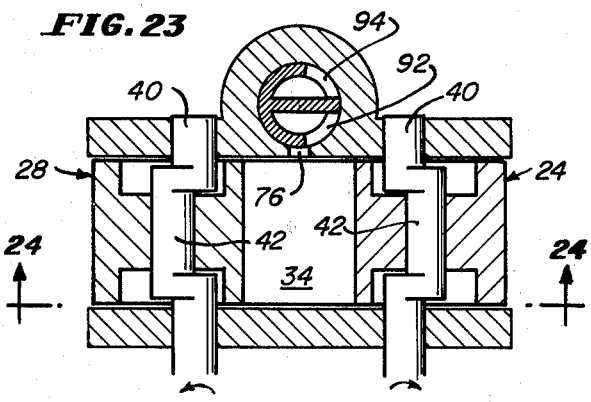
FIG. 23 is a sectional view of the engine showing the end of the power stroke and the beginning of the exhaust stroke.
Figure 24:
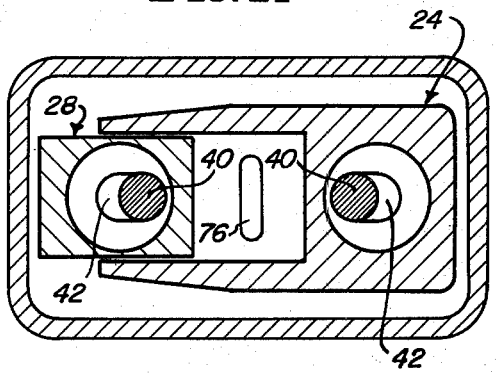
FIG. 24 is a sectional view taken along line 24—24 in the view of FIG. 23, but with parts removed.
Figure 25:
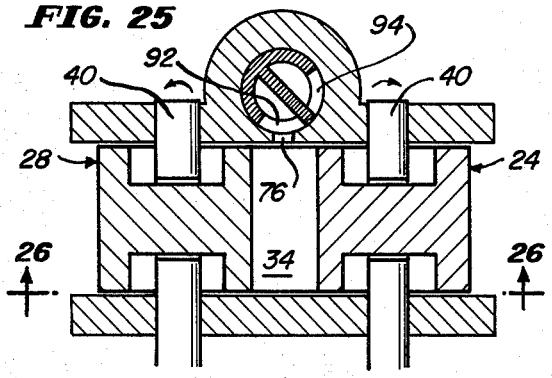
FIG. 25 is a sectional view of the engine showing the execution of the exhaust stroke.
Figure 26:
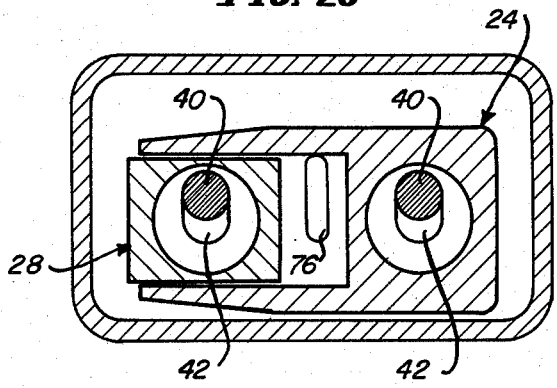
FIG. 26 is a sectional view taken along line 26—26 in the view of FIG. 25, but with parts removed.

When the crankshafts complete their revolution to assume the position shown in FIGS. 19 and 20, the piston and cylinder-piston elements will also assume positions as shown in these figures. The cylindrical valve member, however, will be rotated 180° from that shown in the view of FIG. 11. Such a relationship will indicate the end of the compression stroke and the start of the power stroke. The execution of the power stroke will then be illustrated by the positions of the crankshafts, piston and cylinder-piston elements, as shown in the views of FIGS. 21 and 22; but the cylindrical valve member will again be rotated 180° from that shown in the view of FIG. 13. The end of the power stroke and the start of the exhaust stroke will be illustrated by the positions of the crankshafts, piston and cylinder-piston elements as shown in the views of FIGS. 23 and 24, the cylindrical valve member again being rotated 180° from the position shown in FIG. 15. The execution of the exhaust stroke will then be represented by the relationship of the crankshafts, piston and cylinder-piston elements as shown in the views of FIGS. 25 and 26, the cylindrical valve member being rotated 180° from the position shown in FIG. 17.

Figure 14:
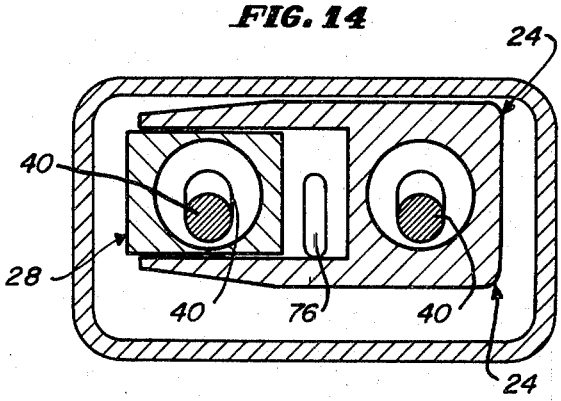
FIG. 14 is a sectional view taken along line 14—14 of the view of FIG. 13, but with parts removed.
Figure 18:
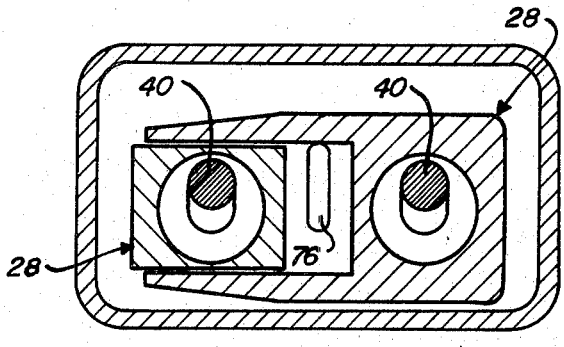
FIG. 18 is a sectional view taken along line 18—18 in FIG. 17, but with parts removed.

The gyratory movement of the piston and cylinder-piston elements is best shown in the views of FIGS. 12, 14, 16, 18, 20, 22, 24 and 26, such gyratory movement being further understood by noting the relative positions of the offset and end portions of the crankshafts. The rotation of the crankshafts are indicated by arrows in the views of FIGS. 11, 13, 15, 17, 19, 21, 23 and 25. An illustrative gyratory turn is seen as commencing with the offset portions being laterally and interiorly displaced in FIG. 12. In this position the piston and the cylinder elements are centrally located within the engine casing. The offset portions are then moved to assume a vertical upper position to thereby raise the piston and cylinder-piston elements and move the piston-cylinder element to the right, and the piston element to the left, as indicated by the view of FIG. 14. The offset portions are then laterally and exteriorly displaced to move the piston and piston-cylinder elements downwardly, the piston-cylinder element to the right and the piston element to the left, as indicated in the view of FIG. 16. The offset portions are then displaced vertically downward to lower the piston and cylinder-piston elements and initiate movement of the cylinder-piston element to the left and piston element to the right, as shown in the view of FIG. 18. The gyratory movement will be completed by assuming the position shown in FIG. 20.

The improved rotary internal combustion engine disclosed herein has been particularly described in relation to four cycle of operation. It should be understood, however, that the features of this invention can be applied in a similar manner to the operation of other cycles, for example, two cycle operation, in accordance with recognized practice. The features of two cycle operation are well known, and practitioners will readily apply such features to the engine disclosed herein.

The internal combustion rotary engine is the preferred embodiment in practice, compression ignition, spark ignition, two cycle, four cycle and the like. It should be understood, however, that the illustrated embodiments may operate otherwise as prime movers. Fuels other than hydrocarbon fuels may be used, for example, hydrogen. Other pressure fluids may also be used to operate the movable elements in the expansion and contraction chamber, the variable volume chamber, or the dynamic volume chamber, which volume is varied by expanding and contracting fluid pressures, or dynamic fluid pressures. Such fluid pressures may include hydraulic, non-combustible gases such as steams, refrigerants and still others. In all such embodiments, the piston and cylinder-piston elements follow opposite gyratory paths in executing power generating cycles.

The claims of the invention are now presented, and the terms in such claims may be further understood by reference to the language of the preceding specification and the views of the drawings.

What is claimed is:

1. A prime mover in which piston and cylinder-piston elements follow gyratory paths in executing power generating cycles, including a cylinder-piston element having a body and spaced, parallel rectilinear flat sidewalls, a piston element having spaced, parallel sides adjoining and coacting with said cylinder-piston rectilinear sidewalls, said piston and cylinder-piston elements partly forming a polyhedron variable volume chamber, in which fluid pressures operate to expand and contract said chamber, stationary rectilinear flat housing parts adjoining and coacting with opposite sides of the said cylinder-piston and piston elements to further define said polyhedron combustion chamber, a rotatable cylinder-piston crankshaft mounted in said cylinder-piston body, an oppositely rotatable piston crankshaft mounted in said piston element, and gearing means interconnecting said crankshafts so that said piston and cylinder-piston elements follow opposite and coordinated gyratory paths.

2. A prime mover as in claim 1 wherein said prime mover is an internal combustion engine operated by hydrocarbon fuels, and said chamber is a combustion chamber.

3. An internal combustion engine as in claim 2 wherein said engine is spark fired.

4. An internal combustion engine as in claim 2 wherein said engine is a compression ignition engine.

5. An internal combustion engine as in claim 2, wherein said piston element has a substantially square configuration having a second pair of parallel sides spaced apart so that the width of the piston element is coextensive with the width of the cylinder-piston rectilinear, flat sidewalls, and said rectilinear sidewalls terminating with rectilinear, flat edges which, together with said pair of piston parallel sides, operate to sealingly engage said rectilinear, flat housing parts at the opposite sides of the cylinder-piston and piston elements.

6. An internal combustion engine as in claim 5, wherein each crankshaft has an intermediate offset portion and opposite aligned end portions, said intermediate offset portion of each rotating crankshaft moving the respective elements to diametrically opposed fully raised and lowered positions in executing a 360° rotation.

7. An internal combustion engine as in claim 6, wherein one of said crankshafts operates as a drive shaft for a work output joined to said drive shaft.

8. An internal combustion engine as in claim 2 which further includes a cylindrical valve member positioned to rotate across an aperture communicating with the combustion chamber, said cylindrical valve member having separated inlet fuel and exhaust spaces, an exhaust port opening into the exhaust space, and an intake port opening into the intake space, and means to rotate said cylindrical valve member in predetermined relation to the rotation of the crankshafts so that said valve sequentially opens and closes said ports during intake, compression, power and exhaust strokes.

9. An internal combustion engine as in claim 8, wherein the means to rotate said cylindrical valve is a gear train interconnecting one of said crankshafts and said cylindrical valve member.

10. An internal combustion engine as in claim 9, wherein the ratios of the gears in said gear train are such that each crankshaft rotates twice for each rotation of the cylindrical valve member.

11. An internal combustion engine as in claim 10, wherein said communicating aperture to the combustion chamber is closed by a midwall portion between the ports and a wall portion extending from one port to the other port, and said cylindrical valve member having a helical gear mounted thereon which operates in said gear assembly to transmit rotational movement to the cylindrical valve member.

12. An internal combustion engine as in claim 11, wherein said intake and exhaust spaces are separated by a diagonal divider web, a portion of said divider web extending to said midwall portion, and said helical gear mounted on the cylindrical valve member meshing with another helical gear which is rotated by a shaft of a bevel gear which, in turn, meshes with a bevel gear which is at right angles to said first bevel gear, a shaft of said second bevel gear being rotated by a first gear which meshes with a second gear mounted on one of said crankshaft ends, said first and second gears having a common vertical axis.

13. An internal combustion engine as in claim 10, wherein said cylindrical valve member is timed to rotate so that the intake port registers with the communicating aperture to the combustion chamber during intake stroke, said communicating aperture being closed by the wall of the cylindrical valve member at the end of the intake stroke, the compression stroke, and the power stroke, and said exhaust port registering with the communicating aperture during the exhaust stroke, said exhaust stroke then being closed following substantial completion of a 360° rotation of said cylindrical valve member.

* * * * *